US010809046B2

(12) United States Patent
Gatti

(10) Patent No.: US 10,809,046 B2
(45) Date of Patent: Oct. 20, 2020

(54) LOADING MACHINE FOR CARTRIDGES WITH A METAL CASE

(71) Applicant: E.M.G. SRL, Pozzaglio Ed Uniti (IT)

(72) Inventor: Giorgio Gatti, Cremona (IT)

(73) Assignee: E.M.G. SRL, Pozzaglio ed Uniti (IT)

( * ) Notice: Subject to any disclaimer, the term of this patent is extended or adjusted under 35 U.S.C. 154(b) by 0 days.

(21) Appl. No.: 16/492,423

(22) PCT Filed: Mar. 20, 2018

(86) PCT No.: PCT/IT2018/050046

§ 371 (c)(1),
(2) Date: Sep. 9, 2019

(87) PCT Pub. No.: WO2018/173087

PCT Pub. Date: Sep. 27, 2018

(65) Prior Publication Data

US 2020/0041242 A1 Feb. 6, 2020

(30) Foreign Application Priority Data

Mar. 22, 2017 (IT) ..... 102017000031474

(51) Int. Cl.
*F42B 33/00* (2006.01)
*F42B 33/02* (2006.01)

(52) U.S. Cl.
CPC ..... *F42B 33/001* (2013.01); *F42B 33/0207* (2013.01)

(58) Field of Classification Search
CPC ..... F42B 33/001; F42B 33/0207
(Continued)

(56) References Cited

U.S. PATENT DOCUMENTS 2,297,730 A 10/1942 Turnock et al.
2,325,642 A * 7/1943 Turnock ..... F42B 33/04 86/23

(Continued)

FOREIGN PATENT DOCUMENTS

EP 2 801 785 11/2014
WO WO 2017/085751 5/2017

OTHER PUBLICATIONS

International Search Report, PCT/IT2018/050046, dated Jun. 18, 2018.
Written Opinion, PCT/IT2018/050046, dated Jun. 18, 2018.

*Primary Examiner* — Bret Hayes
(74) *Attorney, Agent, or Firm* — Nixon & Vanderhye

(57) ABSTRACT

A loading machine for cartridges with metal cases receives the empty cases provided with primer, prepares them and provides them with the components to produce the cartridges. The loading machine includes first and second operating beams, each having alternating vertical translation movement coordinated with one another; a continuously rotating motor activating kinematic mechanisms; a gearbox transmitting motion from the motor to the first and the second operating beam. The gearbox includes: a drive shaft; at least a first and the second connecting rod and crank kinematic mechanism connected to the first operating beam and the drive shaft respectively by a first and second cams; third and fourth connecting rod and crank kinematic mechanisms connected to the second operating beam and to the drive shaft respectively by third and fourth cams. The alternating vertical translation movement of the first beam is independent from the alternating movement of the second beam.

12 Claims, 10 Drawing Sheets

(58) Field of Classification Search
USPC ..... 86/23, 31
See application file for complete search history.

(56) References Cited

U.S. PATENT DOCUMENTS

| | | | | | |
|---|---|---|---|---|---|
| 2,370,828 | A | | 3/1945 | Widmont | |
| 3,150,558 | A | * | 9/1964 | Welch | F42B 33/004 86/23 |
| 3,153,976 | A | * | 10/1964 | Linder | F42B 33/004 86/26 |
| 3,678,799 | A | * | 7/1972 | Leich | F42B 33/004 86/26 |
| 4,475,435 | A | * | 10/1984 | Mantel | F42B 33/002 86/25 |
| 2013/0139675 | A1 | * | 6/2013 | Baxter | F42B 33/001 86/31 |
| 2014/0260925 | A1 | * | 9/2014 | Beach | F42B 33/001 86/28 |

* cited by examiner

LOADING MACHINE FOR CARTRIDGES WITH A METAL CASE

FIELD OF APPLICATION

The present invention relates to the sector of lines for the production and loading of cartridges, and in particular relates to a loading machine for cartridges with a metal case, equipped to receive the empty cases provided with a primer, and to prepare them and provide them with the components needed to produce cartridges that are ready for use.

STATE OF THE ART

Patent application No. 102015000074220 (UB2015A005750) by the same applicant discloses a loading machine for cartridges with a metal case substantially comprising a frame structure, feed means for metal cases, for ogival balls and for gunpowder, a first operating beam supporting accessory means for in-line loading and processing of said cartridges, a second operating beam supporting centering cylinders for said metal cases during loading, feed and conveying means of the cartridges and means for ejecting the loaded cartridges.

Said first operating beam has an alternating vertical translation movement and is provided with working tools having a vertical axis.

Said second operating beam also has an alternating vertical translation movement, coordinated with the alternating vertical translation movement of said first operating beam.

Said second operating beam is provided with a plurality of hollow centering cylinders, having a vertical axis.

Each centering cylinder is arranged along said second operating beam so that its vertical axis coincides with the vertical axis of one of said filling tools provided on said first operating beam.

Said first and said second operating beam are connected to each other by means of a telescopic joint maintained extended by means of elastic means, such as coil springs.

Said frame structure comprises vertical guides engaged simultaneously by said first and said second operating beam, so that the respective planes to which said beams belong remain parallel to each other during the translation movement, to ensure stable coaxiality between the vertical axis of each centering cylinder and the vertical axis of the corresponding working tool.

Said cartridge feed and conveying means extend along an elliptical trajectory and generally comprise a race on which the metal cases are positioned and slid, resting on the base with the open end pointing upwards, wherein the accessory loading means, or working tools, perform checking operations and introduce in sequence the various components that will fill and complete the whole cartridge.

Said cartridge feed and conveying means further comprise a conveyor guide, comb shaped and arranged parallel to said race, along its side turned towards the front of the machine and the operator, adapted to convey said cartridges along said race, to position them, according to the various filling steps, under the respective accessory loading means.

Finally, the machine comprises motor means for activation of all the kinematic mechanisms and a control unit adapted to supervise all its functions.

In particular, said machine comprises a continuously rotating motor, adapted to transfer an alternating movement to said first operating beam.

In its vertical translation movement, said first beam drives said second beam.

In particular:

said first beam, controlled by the motor means by means of an oscillating kinematic mechanism, descends vertically along the vertical guides pushing said second beam below it;

when said second beam encounters the feed plane of the cases it stops, while said first operating beam continues its descent autonomously to insert loading components into the cases;

during the autonomous descent of said first beam, the elastic means contained in the telescopic joint interposed between said first and said second beam are compressed;

after the cases have been loaded, said first operating beam starts to rise again controlled by the motor means and the elastic means start to relax;

once the elastic means are completely relaxed and the telescopic joint has been returned to its maximum extension, the second operating beam also starts to rise again, driven by the motion of said first beam.

The main problems of these loading machines for cartridges with a metal case concerns the coordinated conveying system of the two operating beams, and the difficulty of maintaining the feed means of the cases and of the ogival balls, the various filling tools and the centering cylinders of the cases all perfectly synchronized during the various loading phases.

In particular, the reaction force of the elastic means comprised in the telescopic joint between said first and said second operating beam is not always easily governable and disadvantageously there is the risk that the speeds and the accelerations of said second beam cannot be perfectly controlled, as they depend on those of the first beam and on the elastic connection between them.

If the coordination and the synchronism between said first and said second operating beam is not perfect there is the risk of ruining and damaging the case during filling.

Similarly, there may disadvantageously be a deformation of the ball during its positioning on the case, or its positioning may be inclined with respect to the axis of the case, which could compromise the trajectory of the bullet when fired.

Further disadvantages concern the long times required to prepare and synchronize the machine during installation, but also after stops for maintenance, with consequent slowdowns, reductions in productivity and economic losses.

PRESENTATION OF THE INVENTION

The invention intends to overcome these limits, producing an improved loading machine that ensures automatically, throughout the loading cycle, perfect synchronization during movement of the two operating beams, and consequently of the centering cylinders and of the various loading tools, to protect all the components of the cartridge, starting from the metal case itself, from possible deformations that could compromise their efficient use.

Another object of the invention is to produce an efficient and productive improved loading machine, provided with kinematic mechanisms that allow rapid and safe operation for preparation of the machine during construction, maintenance and change-over for loading of cases of different length.

These objects are achieved by an improved loading machine for cartridges with a metal case comprising:

a frame structure;

feed means for a plurality of cases having a given caliber and a longitudinally extending axis;

feed means for a plurality of ogival balls adapted to act as bullets;

feed means for gunpowder;

a first operating beam having an alternating vertical translation movement, provided with working tools having a vertical axis, adapted to load said cases;

a second operating beam, having an alternating vertical translation movement coordinated with the alternating vertical translation movement of said first operating beam, wherein said second operating beam is provided with a plurality of hollow centering cylinders, having a vertical axis, each centering cylinder being arranged so that its vertical axis coincides with the vertical axis of one of said tools;

feed and conveying means of said cases during loading;

means for ejecting the loaded cartridges;

motor means adapted to produce a continuous rotational motion for activation of the kinematic mechanisms;

a control unit, where said frame structure comprises vertical guides engaged simultaneously by said first and said second operating beam, characterized in that said machine comprises a gearbox adapted to transmit motion from said motor means to said first and said second operating beam, and said gearbox comprises:

a drive shaft having a longitudinal axis, operated by said motor means;

at least a first and a second connecting rod and crank kinematic mechanism connected to said first operating beam;

at least a third and a fourth connecting rod and crank kinematic mechanism connected to said second operating beam, where:

said first and said second kinematic mechanism are connected to said drive shaft respectively by means of a first cam and a second cam with globoidal profile;

said third and said fourth kinematic mechanism are connected to said drive shaft respectively by means of a third cam and a fourth cam with globoidal profile, so that the alternating vertical translation movement of said first beam is independent from the alternating movement of said second beam.

Advantageously, said first and said second cam are the same as each other, said third and said fourth cam are the same as each other, but said first and said second cam are different from said third and said fourth cam, so as to obtain movements with different speeds and accelerations of said first and second operating beam.

According to a first aspect of the invention, each of said first, second, third and fourth kinematic mechanism comprises, connected to one another by means of hinges, a connecting rod, a crank and a sliding rod, where said crank is operated by the rotation of said drive shaft and said sliding rod is integral with the respective operating beam.

In particular, said crank comprises a rocker provided with a plurality of rollers adapted to be driven by the respective cam with globoidal profile.

In a preferred version of the invention, said gearbox comprises:

at least a fifth and a sixth connecting rod and crank kinematic mechanism connected to said first operating beam, arranged symmetrically with respect to said first and second kinematic mechanism with respect to a vertical plane passing through the axis of said drive shaft;

at least a seventh and an eighth connecting rod and crank kinematic mechanism connected to said second operating beam, arranged symmetrically with respect to said third and fourth kinematic mechanism with respect to a vertical plane passing through the axis of said drive shaft.

Advantageously, each rocker comprises a shaft at the ends of which the cranks of the respective kinematic mechanisms are constrained.

According to a further aspect of the invention, said frame structure comprises sleeve guides adapted to house said sliding rods.

According to a possible variant of embodiment, said feed means for a plurality of ogival balls comprise a rotary table and said gearbox comprises a kinematic mechanism connected to said drive shaft by means of a fifth cam with globoidal profile, where said kinematic mechanism is adapted to transform the continuous motion of said drive shaft into an intermittent rotary motion for said rotary table.

In particular, said rotary table comprises gripping means for said ogival balls arranged at the four vertices of a square.

Moreover, said kinematic mechanism comprises a grooved shaft and a rocker provided with a plurality of rollers adapted to be driven by said fifth cam with globoidal profile.

The advantages of the invention are multiple and are illustrated below.

The gearbox according to the invention allows the movements of the two operating beams, although always coordinated, to be independent.

By suitably sizing the cams with globoidal profile, each connecting rod-crank kinematic mechanism can ensure that the respective operating beam obtains given vertical translation speeds and accelerations, different from those of the other operating beam.

By choosing the length of said cranks, of said connecting rods and of said sliding rods, it is possible to adapt the machine to different productions, as a function of the caliber and of the components of the cartridges.

Once the components of the gearbox have been defined and designed, perfect synchronization of all the kinematic mechanisms of the machine, and therefore of the coordinated movements of the operating beams and of the feed means, will always be guaranteed.

Due to constant synchronization of the components, it is possible to increase the operating speeds, making the machine more productive.

This also results in rapid preparation of the machine during installation and testing, ensuring that all the movements of all the components are coordinated and synchronized with one another.

By optimizing the machine preparation times, which are drastically reduced, production is significantly increased, with a consequent economic benefit.

In the more complete version of the machine, with a single continuously rotating motor means it is possible to obtain five different alternating movements that are combined with one another, with the advantage of also optimizing spaces and footprints.

BRIEF DESCRIPTION OF THE DRAWINGS

The advantages of the invention will be more apparent below, in the description of a preferred embodiment, provided by way of non-limiting example, and with the aid of the drawings, wherein.

DETAILED DESCRIPTION OF AN EXAMPLE OF PREFERRED EMBODIMENT

Figure 1:
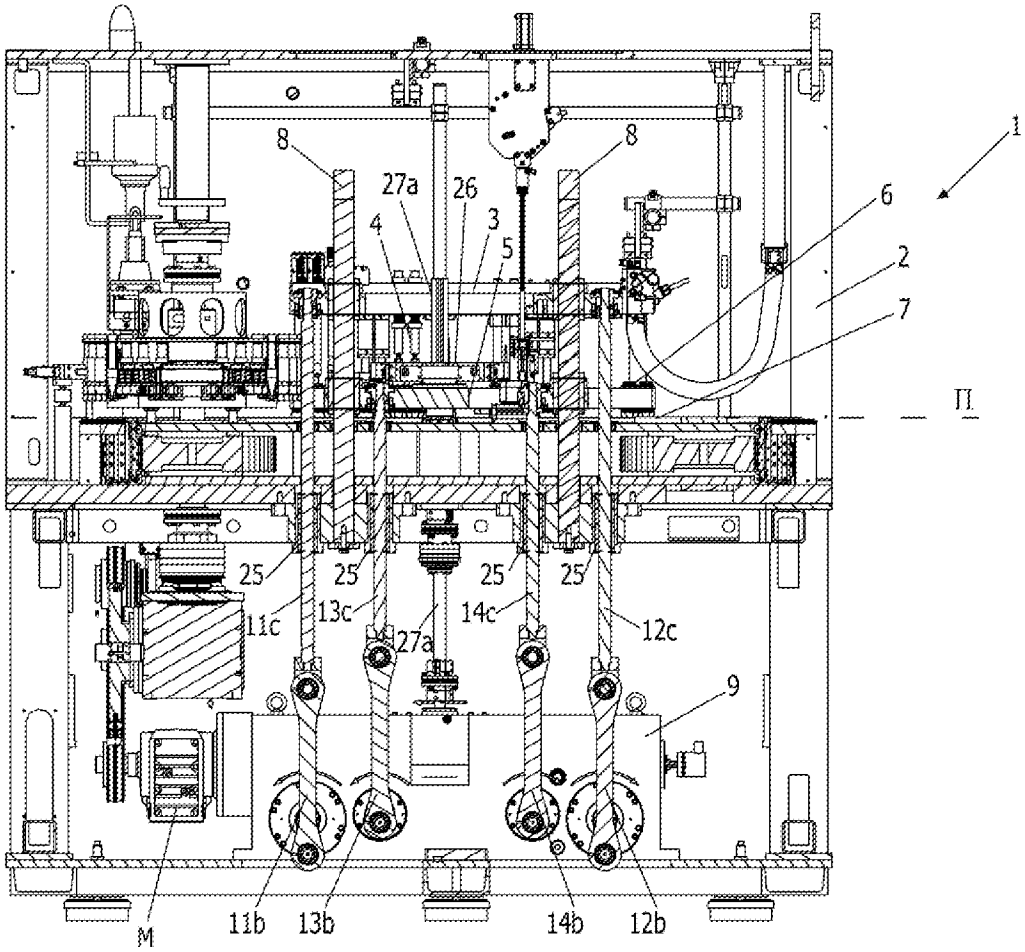
FIG. 1 represents, in a partially sectional front view, an improved loading machine for cartridges with a metal case according to the invention.

With reference to FIG. 1, there is illustrated an improved loading machine 1 for cartridges with a metal case, adapted for the preparation and production of ammunition with a single ogival ball used in the sporting and military sector.

Said machine 1 essentially comprises:

a frame structure 2 provided with feed means for a plurality of cases having a given caliber and a longitudinally extending axis, and feed means for a plurality of ogival balls and for gunpowder;

a first operating beam 3 having an alternating vertical translation movement, provided with working tools 4 having a vertical axis, adapted to load and process said cases;

a second operating beam 5, also having an alternating vertical translation movement coordinated with the alternating vertical translation movement of said first operating beam 3, provided with a plurality of hollow centering cylinders 6, having a vertical axis;

feed and conveying means 7 of said cases during loading;

means (not shown) for ejecting the loaded cartridges;

motor means M for activation of all the kinematic mechanisms;

a gearbox 9 for transmission of motion from said motor means M to said first 3 and said second 5 operating beam;

a control unit (not shown) adapted to supervise all functions of the machine 1.

Each centering cylinder 6 is arranged along said second operating beam 5 so that its vertical axis coincides with the vertical axis of one of said filling tools 4 provided on said first operating beam 3.

Said frame structure 2 comprises vertical guides 8 engaged simultaneously by said first 3 and said second 5 operating beam, so that the respective planes to which said beams 3, 5 belong remain parallel to each other during the translation movement, to ensure stable coaxiality between the vertical axis of each centering cylinder 6 and the vertical axis of the corresponding working tool 4.

Said feed means 7 of said cases extend along an elliptical trajectory and substantially comprise according to the state of the art:

a race adapted to support and to allow feed of said cases in a given direction on a reference plane $\pi$ made perfectly horizontal and perpendicular to the vertical guides 8;

a conveyor guide, arranged parallel to said race, comb shaped to house each case during its movement.

Figure 2:
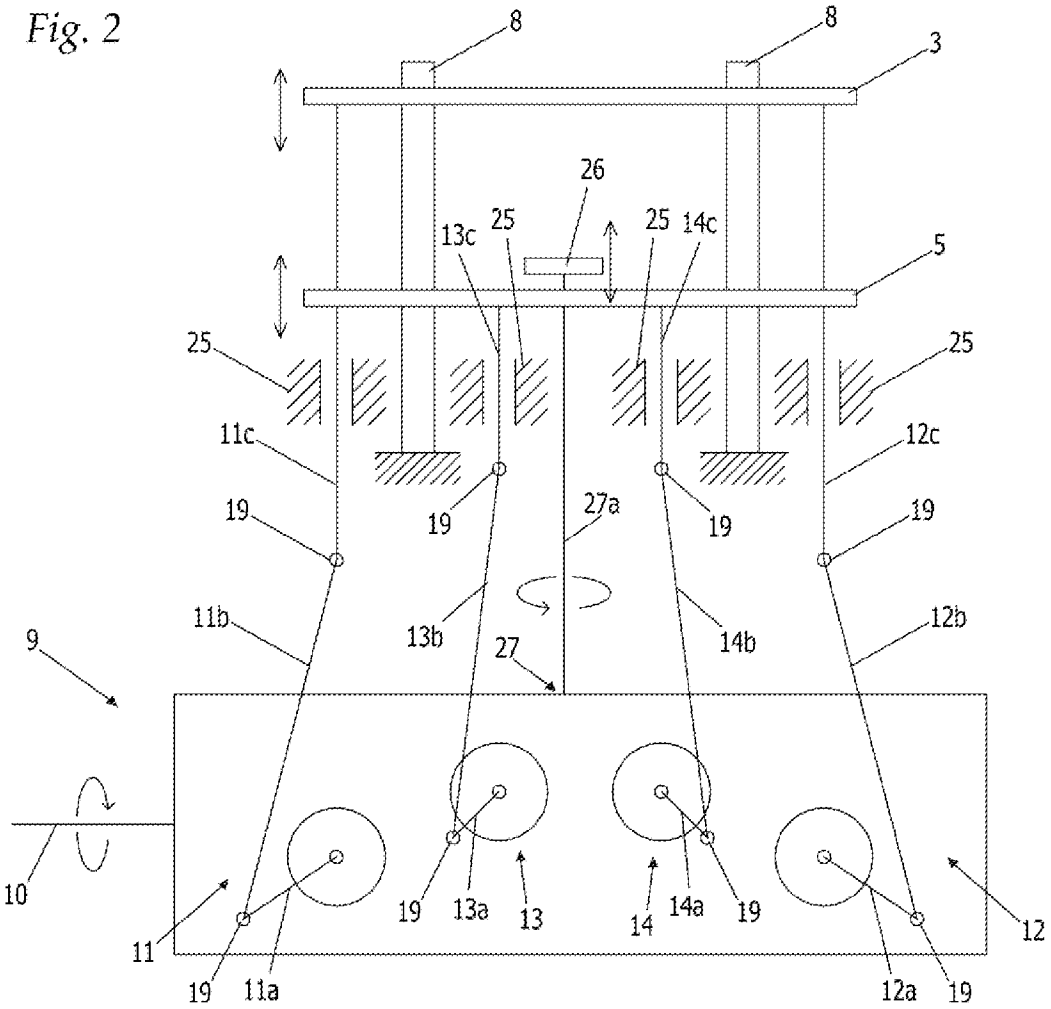
FIG. 2 represents, with a simplified diagram, some kinematic mechanisms of the improved loading machine according to the invention.

With reference to the diagram of FIG. 2, to the sections of FIGS. 4-9 and to the views of FIGS. 10-13, the kinematic mechanisms that form said gearbox 9 are illustrated.

Said gearbox 9 comprises:

a drive shaft 10 having a longitudinal axis, operated continuously by said motor means M, a first 11 and a second 12 connecting rod and crank kinematic mechanism, both connected to said first operating beam 3 and to said drive shaft 10;

a third 13 and a fourth 14 connecting rod and crank kinematic mechanism, both connected to said second operating beam 5 and to said drive shaft 10.

Each of said first 11, second 12, third 13 and fourth 14 kinematic mechanism comprises a crank 11*a*, 12*a*, 13*a*, 14*a*, a connecting rod 11*b*, 12*b*, 13*b*, 14*b*, and a sliding rod 11*c*, 12*c*, 13*c*, 14*c*, connected to one another by means of hinges 19, where said crank 11*a*, 12*a*, 13*a*, 14*a* is operated by the rotation of said drive shaft 10 and said sliding rods 11*c* and 12*c* are integral with said first operating beam 3 and said sliding rods 12*c* and 14*c* are integral with said second operating beam 5.

Said frame structure 2 comprises sleeve guides 25, schematized in FIG. 2 and better depicted in FIG. 1, adapted to house said sliding rods 11*c*, 12*c*, 13*c*, 14*c* and to maintain them aligned during their vertical sliding.

Figure 4:
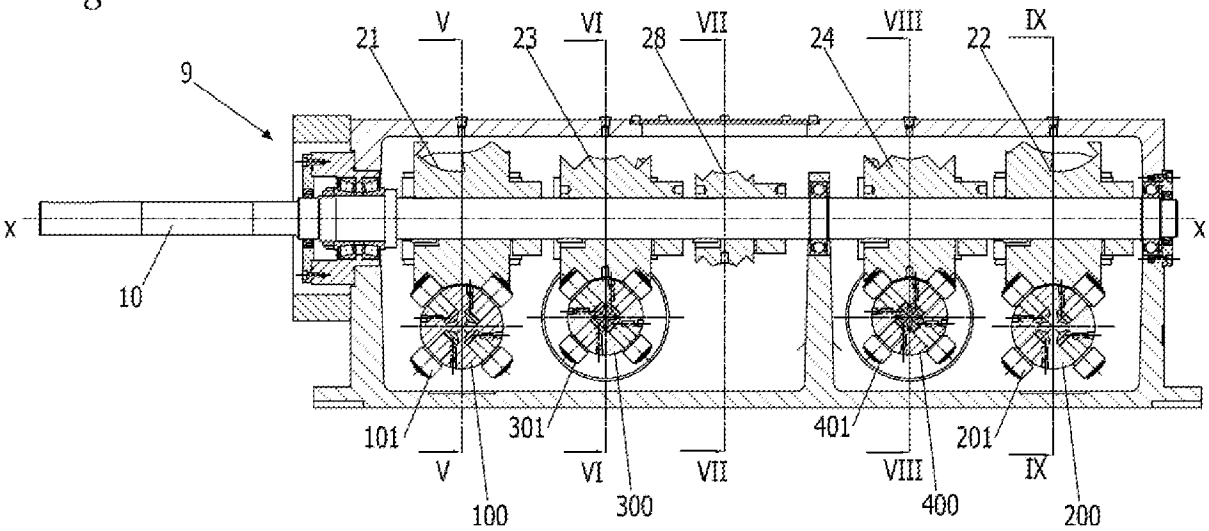
Figure 6:
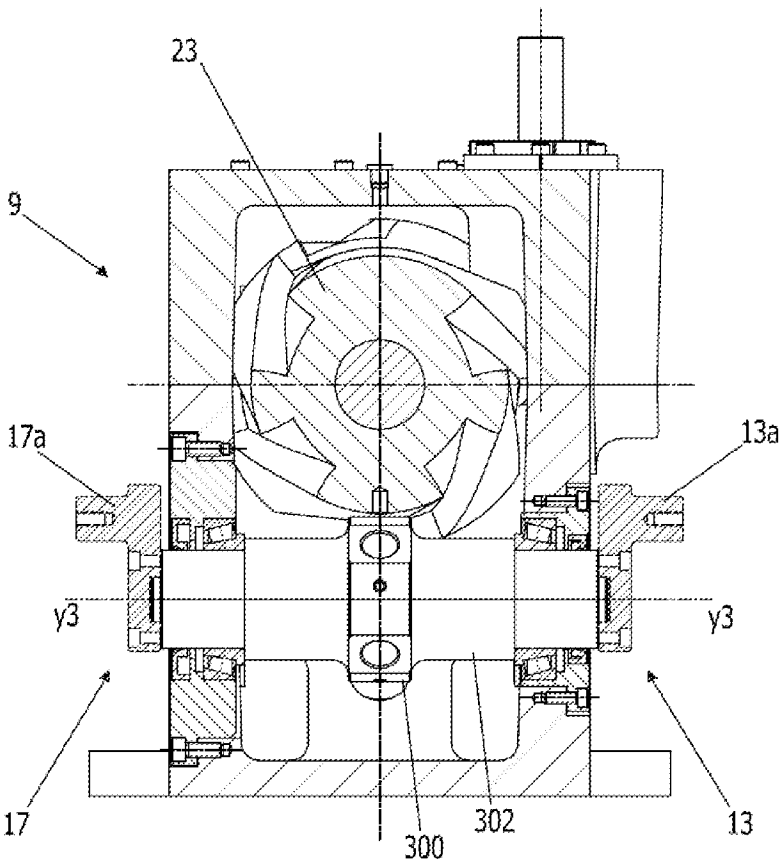
FIGS. 5-9 represent, in a section along parallel vertical planes, the gearbox of FIG. 4.

As illustrated in the vertical section of FIG. 4:

said first 11 and said second 12 kinematic mechanism are connected to said drive shaft 10 respectively by means of a first cam 21 and a second cam 22 with globoidal profile;

said third 13 and said fourth 14 kinematic mechanism are connected to said drive shaft 10 respectively by means of a third cam 23 and a fourth cam 24 with globoidal profile.

Said cams 21, 22, 23, 24 with globoidal profile are integral with said drive shaft 10 and rotate with it.

Said first operating beam 3 and said second operating beam 5 are therefore connected to a single drive shaft 10, but by means of different connecting rod and crank kinematic mechanisms 11, 12, 13, 14 and different cams 21, 22, 23, 24 with globoidal profile, suitably sized, so that the alternating vertical translation movement of said first beam 3 is independent from the alternating movement of said second beam 5.

Each crank 11*a*, 12*a*, 13*a*, 14*a* comprises, at its end for connection to the drive shaft 10 by means of the respective cam, a rocker 100, 200, 300, 400.

The axis y1, y2, y3, y4 of said rocker 100, 200, 300, 400 belongs to a horizontal plane and is perpendicular to the rotation axis x of said drive shaft 10.

Said rocker 100, 200, 300, 400 is provided with a plurality of rollers 101, 201, 301, 401 adapted to be driven by the respective cam 21, 22, 23, 24 with globoidal profile.

In the variant illustrated, said rollers 101, 201, 301, 401 are four for each rocker, equidistant from one another along the circumference of the rocker itself.

Said rollers 101, 201, 301, 401 are always in contact with the profile of the respective cam 21, 22, 23, 24, so that the continuous rotational motion of the drive shaft 10 is converted into a continuous rotational motion of said rocker 100, 200, 300, 400.

With particular reference to FIGS. 10-13, which illustrate the kinematic mechanisms of the gearbox 9 in four different operating positions, it is possible to reconstruct the operation of the gearbox itself and the cooperation between the main components of the improved loading machine 1.

The continuous rotation of said rocker 100, 200, 300, 400 translates into a rotation through 360° of the crank 11*a*, 12*a*, 13*a*, 14*a* associated with it, and said continuous rotation of said crank 11*a*, 12*a*, 13*a*, 14*a* translates, due to said connecting rods 11*b*, 12*b*, 13*b*, 14*b*, into an alternating vertical translation movement of the respective rod 11*c*, 12*c*, 13*c*, 14*c* that supports the corresponding operating beam 3, 5, which as a consequence is raised (FIG. 10) and lowered (FIG. 12) with respect to the plane π on which said cases are fed and conveyed during loading.

Figure 3:
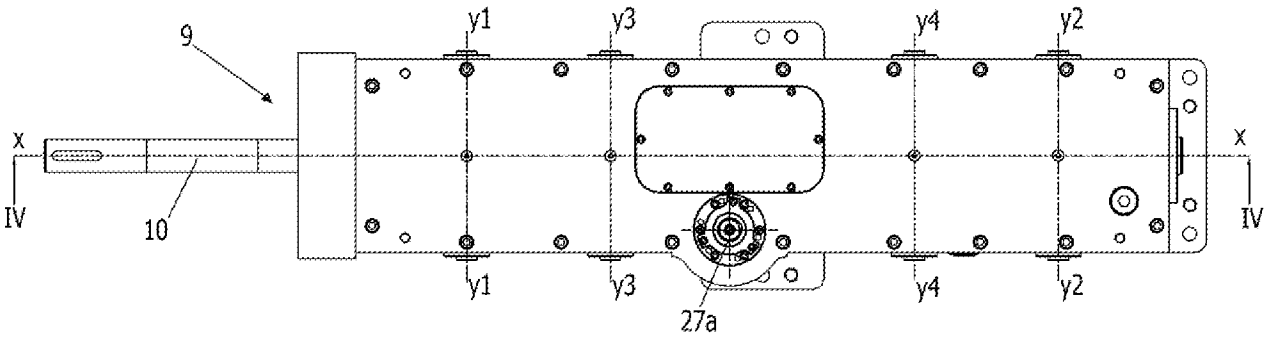
FIGS. 3 and 4 represent, respectively in a top plan view and in a section along a vertical plane, the gearbox mounted on the improved loading machine according to the invention.

With particular reference to the top plan view of FIG. 3 and to the various vertical sections of FIGS. 5-6 and 8-9, said gearbox 9, in a preferred variant of the loading machine 1, comprises:

a fifth 15 and a sixth 16 connecting rod and crank kinematic mechanism, also connected to said first operating beam 3, arranged symmetrically to said first 11 and second 12 kinematic mechanism with respect to a vertical plane passing through the axis x of said drive shaft 10;

a seventh 17 and an eighth 18 connecting rod and crank kinematic mechanism, also connected to said second operating beam 5, arranged symmetrically to said third 13 and fourth 14 kinematic mechanism with respect to a vertical plane passing through the axis x of said drive shaft 10.

Said fifth 15 and said sixth 16 kinematic mechanisms are connected to said drive shaft 10 respectively by means of said first cam 21 and said second cam 22 with globoidal profile.

In the same way, said seventh 17 and said eighth 18 kinematic mechanisms are connected to said drive shaft 10 respectively by means of said third cam 23 and said fourth cam 24 with globoidal profile.

In this configuration, each rocker 100, 200, 300, 400 comprises a shaft 102, 202, 302, 402 at the ends of which the cranks 11*a*-15*a*, 12*a*-16*a*, 13*a*-17*a*, 14*a*-18*a* of the respective kinematic mechanisms are constrained.

Figure 5:
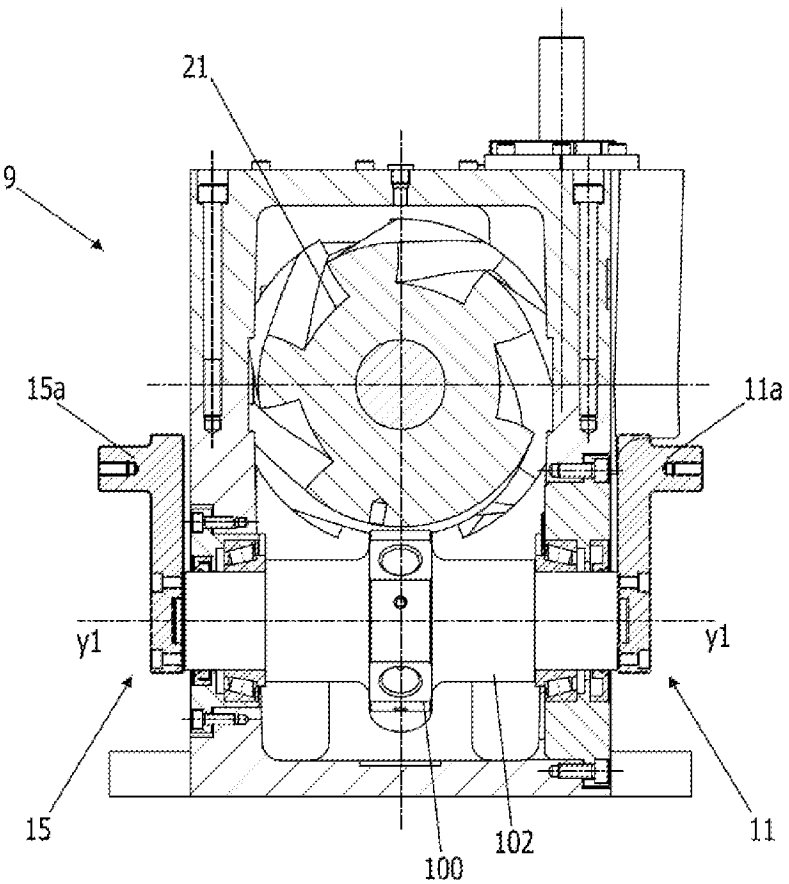

With reference to the section of FIG. 4 and, by way of example, to the section of FIG. 5, said first cam 21 drives the rollers 101 of the corresponding rocker 100, on the shaft 102 of which the cranks 11*a* and 15*a* of said first kinematic mechanism 11 and of said fifth kinematic mechanism 15 are simultaneously constrained, both adapted to move said first operating beam 3.

With reference to FIGS. 1, 2, 14 and 15, said feed means for a plurality of ogival balls comprise a rotary table 26 adapted to receive the ogival balls and to align them with the single cases for their correct insertion.

In particular, said rotary table 26 comprises gripping means for said ogival balls arranged at the four vertices of a square.

Said gripping means substantially comprise grippers 32, adapted to retain said ogival balls between their arms while they are conveyed from the feed point to the vicinity of the cases.

Inside said grippers 32, said ogival balls are also correctly arranged along a vertical axis that will coincide with the vertical axis of the cases into which they will be inserted.

Figure 7:
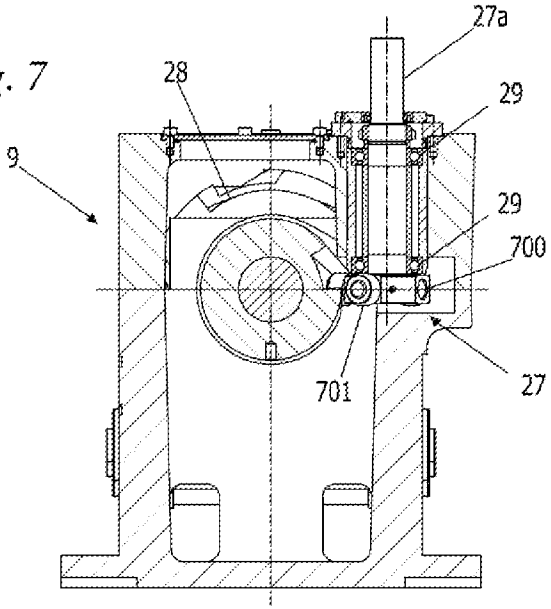

With particular reference to FIG. 3 and to the sections of FIGS. 4 and 7, said gearbox 9 comprises a kinematic mechanism 27 connected to said drive shaft 10 by means of a fifth cam 28 with globoidal profile adapted to transform the continuous motion of said drive shaft 10 into an intermittent rotary motion for said rotary table 26.

Besides rotating around its axis, said rotary table 26 is also provided with a vertical translation movement coordinated with the movement of said second operating beam 5.

It is therefore fundamental that said table 26 rotates intermittently, i.e. rotates during lowering or raising said second operating beam 5, but remains at a standstill during loading of the ogival ball at the feed means and during release of this ball into the corresponding case below.

Said kinematic mechanism 27 for connection of said rotary table 26 to said drive shaft 10 comprises a vertical grooved shaft 27*a*.

With reference to the section of FIG. 7, said kinematic mechanism 27 comprises a rocker 700 provided with a plurality of rollers 701 adapted to be driven by said fifth cam 28 with globoidal profile. Said shaft 27*a* is guided by bearings 29 that ensure its perfect verticality.

Figure 15:
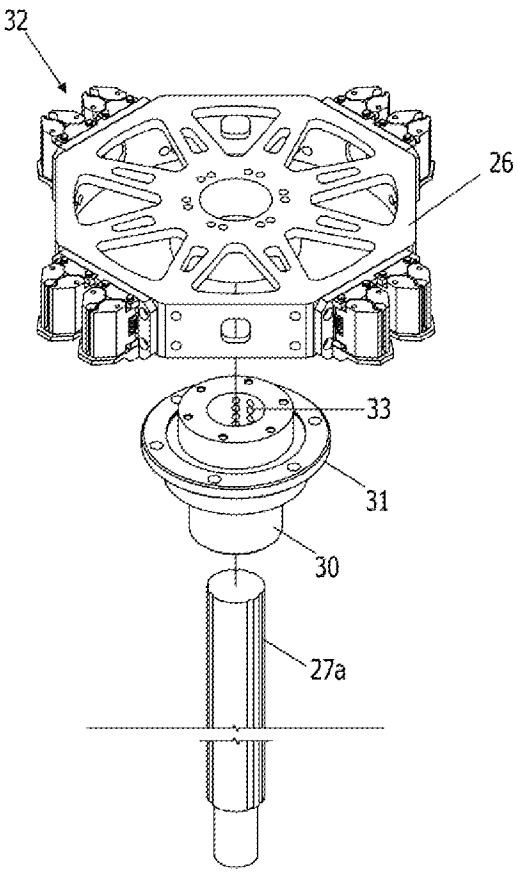
FIGS. 14-15 represent, respectively in a vertical section and in an exploded axonometric view, some components of the improved loading machine according to the invention.
Figure 14:
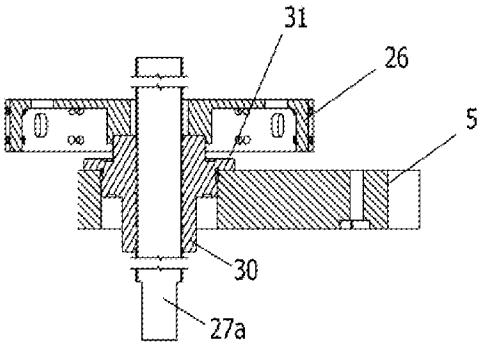
Figure 9:
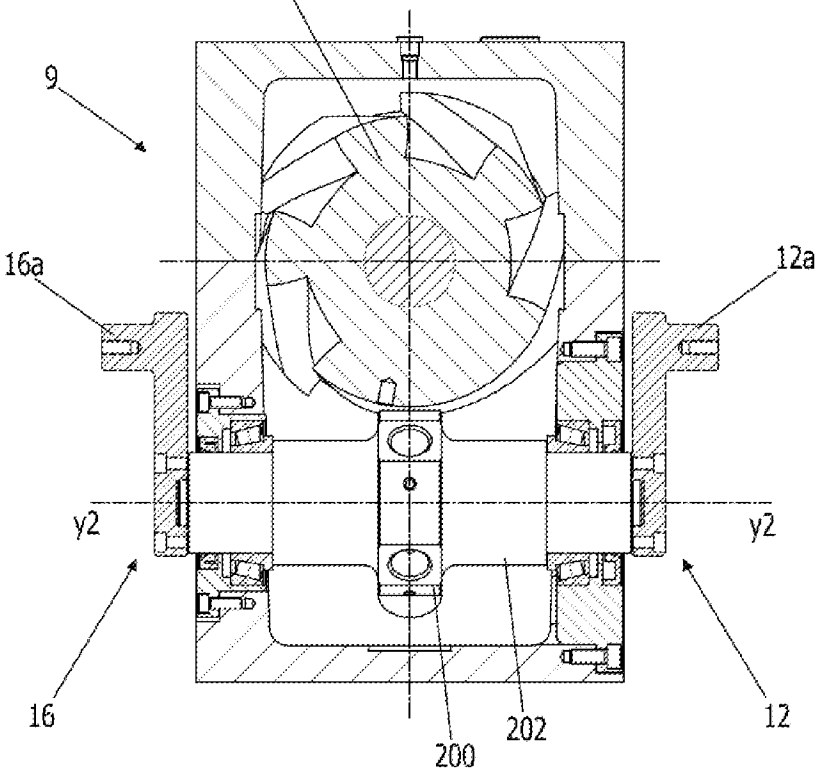
Figure 8:
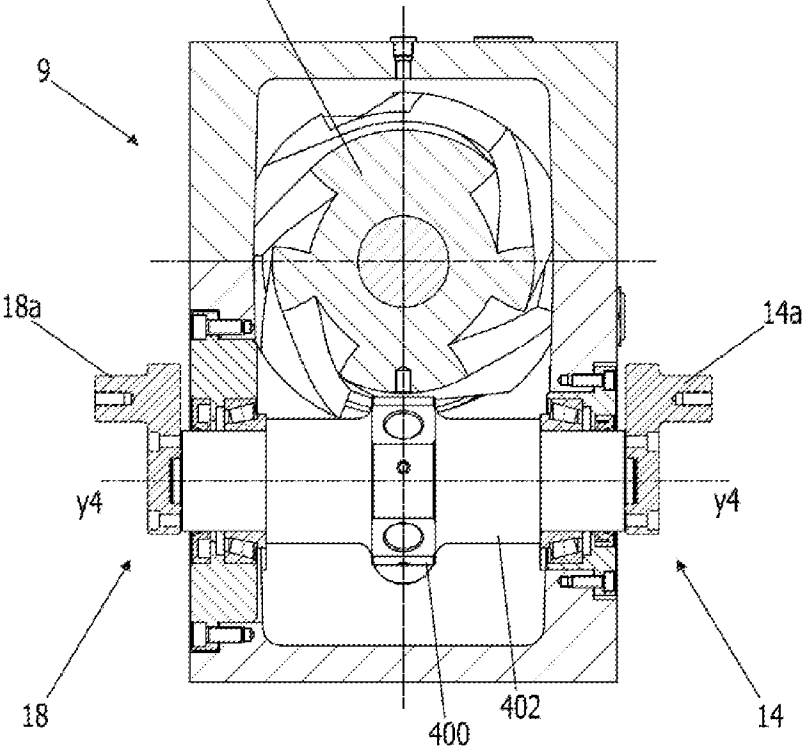
Figure 10:
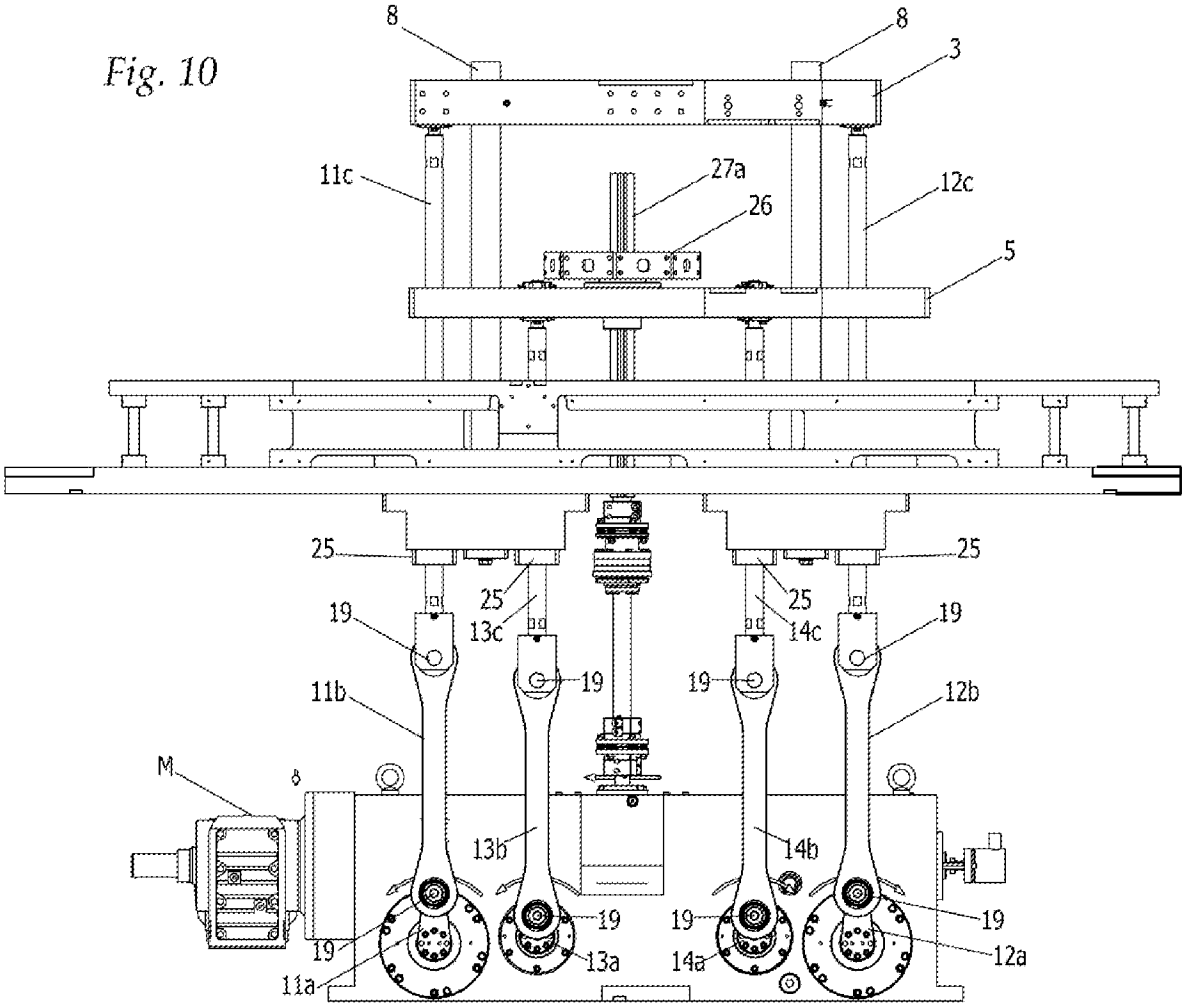
FIGS. 10-13 represent, in a front view, the kinematic mechanisms of the improved loading machine of FIG. 2, in four different operating positions.
Figure 11:
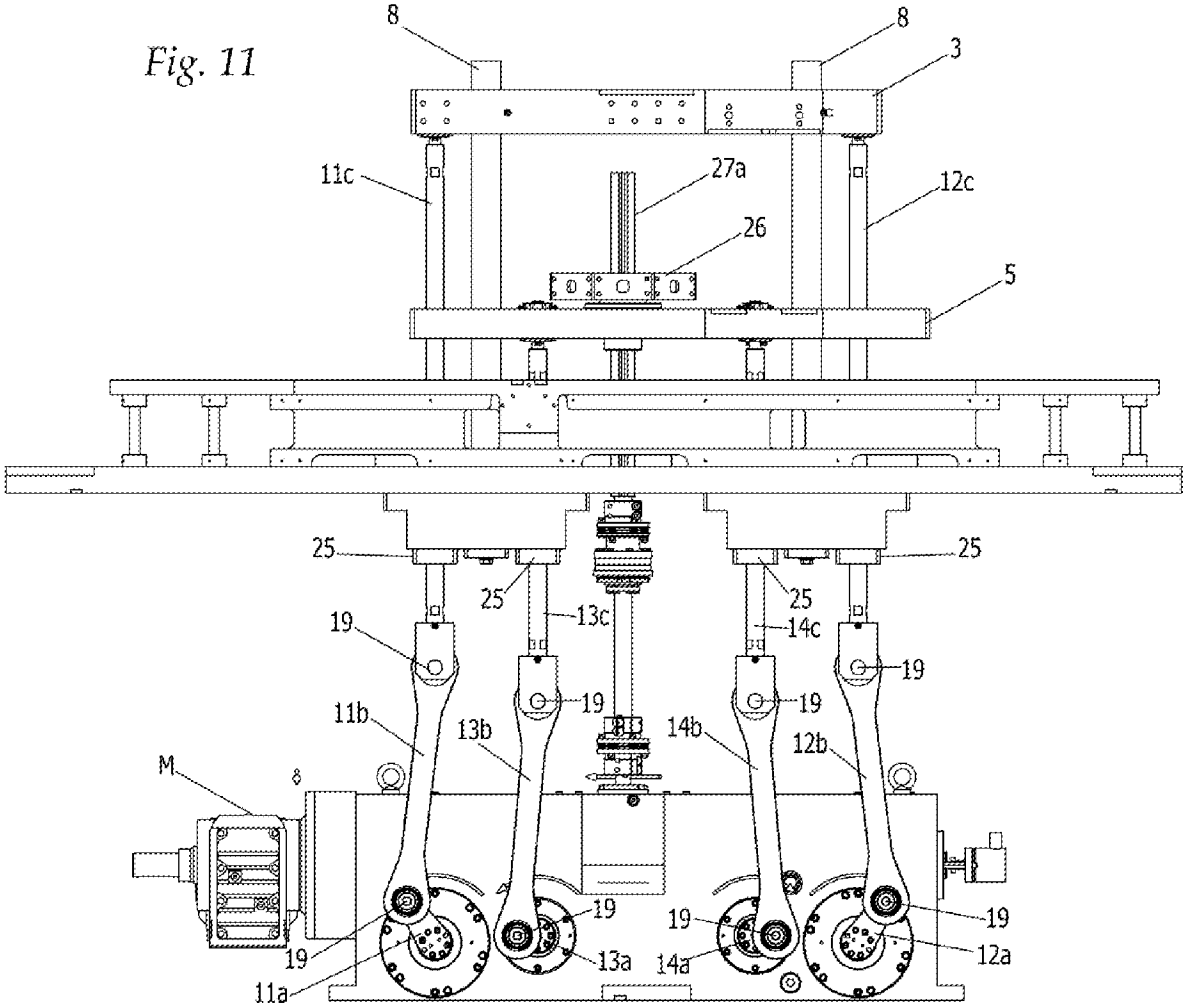
Figure 12:
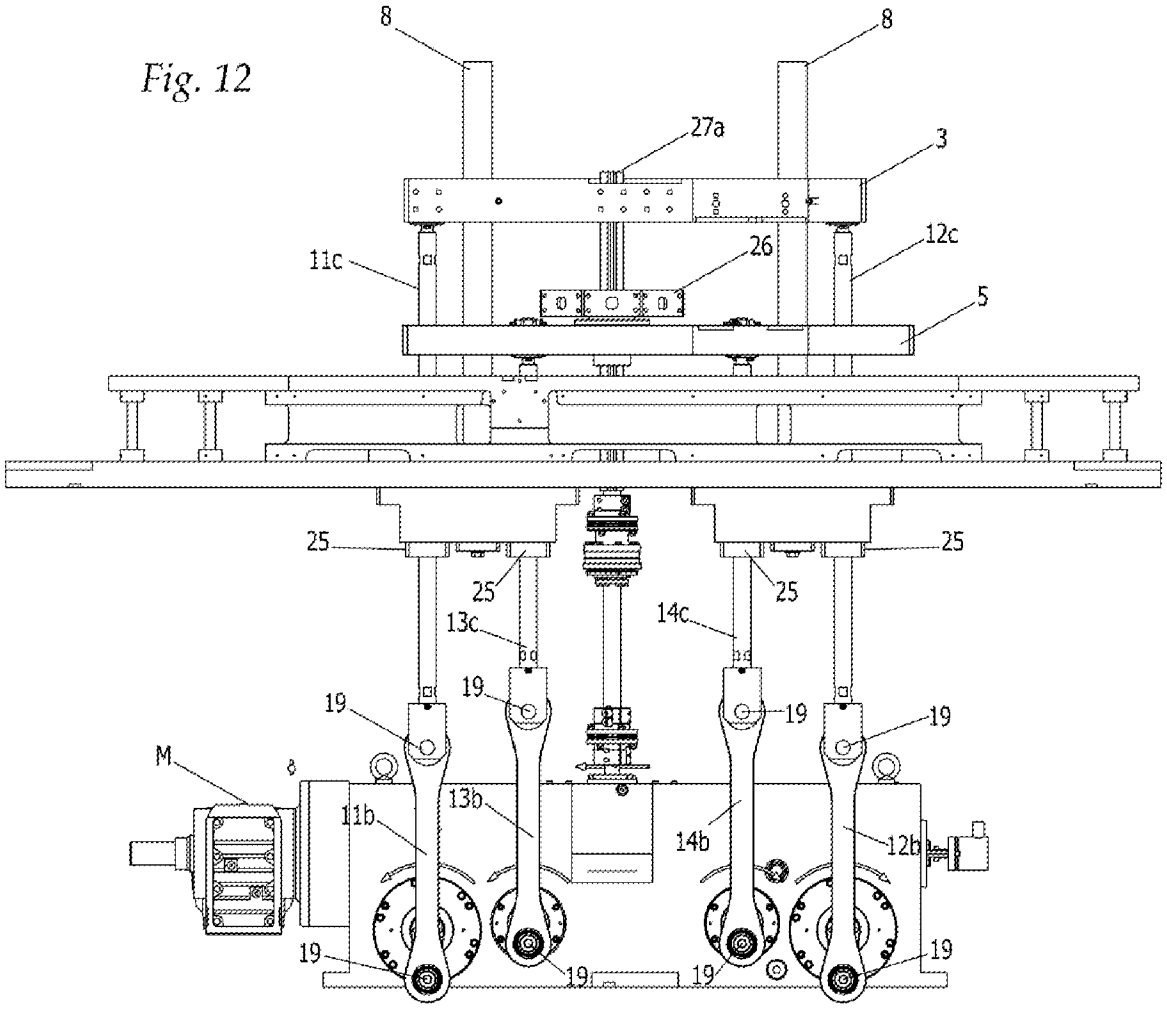
Figure 13:
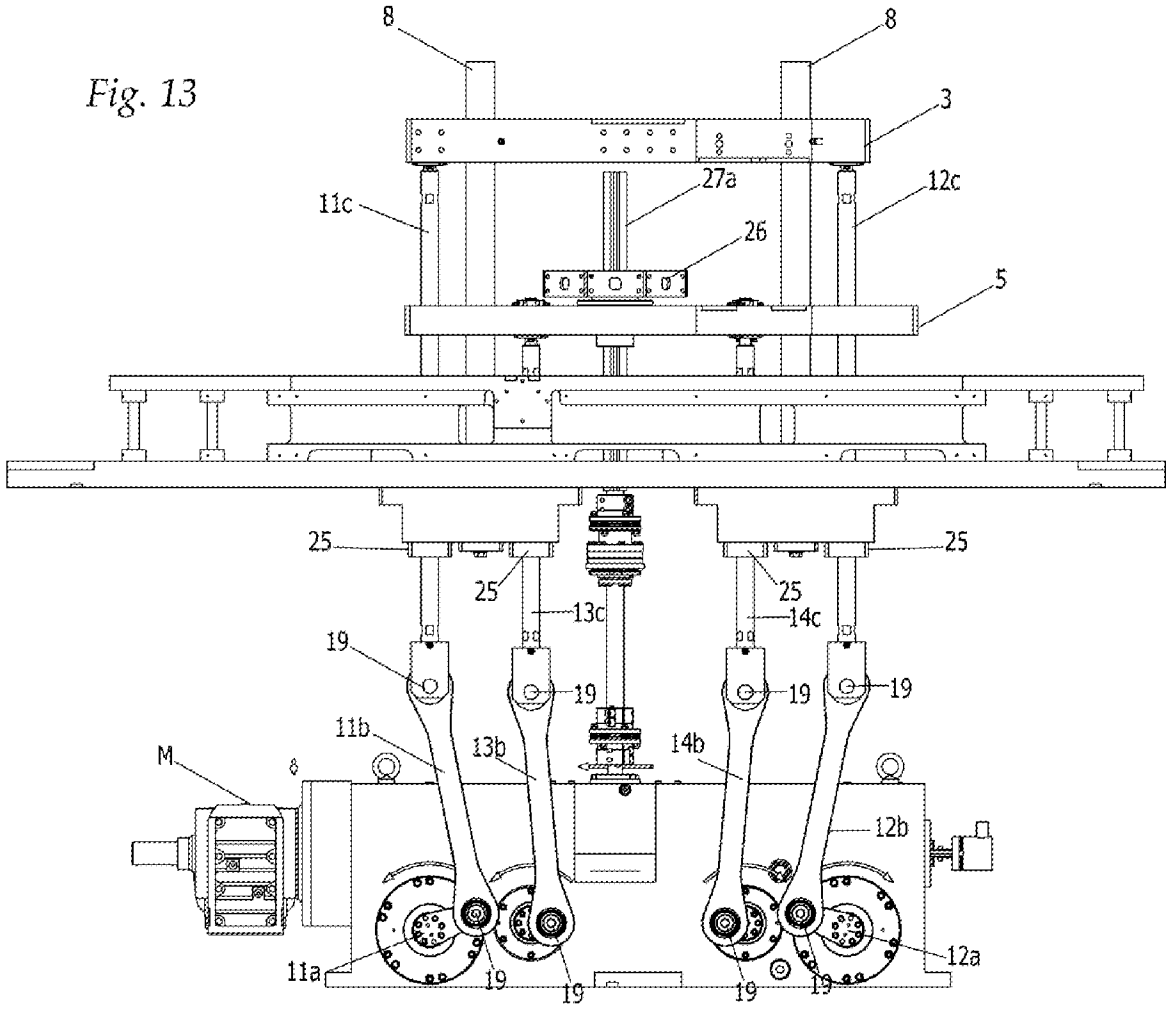

With particular reference to FIGS. 14 and 15, the constraints for fixing said rotary table 26 to said second operating beam 5 and said rotary table 26 to said grooved shaft 27*a* are illustrated.

Said second operating beam 5 comprises a fixing flange 31, provided internally with a ball sleeve 30 that allows rotation of the shaft 27*a*.

Between said flange 31 and said sleeve 30 ball bearings are provided, adapted to disconnect said flange 31 and said sleeve 30 so as to allow rotation of said table 26 with respect to said second operating beam 5.

Said sleeve 30 is provided, on its inner surface, with a plurality of protruding balls 33 adapted to cooperate with said grooved shaft 27*a*, so as to guide the vertical sliding of said table 26 with said second operating beam 5.

The invention claimed is:

1. An improved loading machine for cartridges with a metal case, the machine comprising:

a frame structure;

a case feeder configured to feed a plurality of cases having a specific caliber and a longitudinally-extending axis;

a ball feeder configured to feed a plurality of ogival balls configured to act as bullets;

a first operating beam having an alternating vertical translation movement, provided with working tools having a vertical axis, configured to load said cases;

a second operating beam, having an alternating vertical translation movement coordinated with the alternating vertical translation movement of said first operating beam, said second operating beam being provided with a plurality of hollow centering cylinders, having a vertical axis, each centering cylinder being disposed so that said vertical axis coincides with the vertical axis of one of said tools;

a feed and conveying system to feed and convey said cases during loading;

an ejector configured to eject loaded cartridges;

a motor configured to produce a continuous rotational motion for activation of kinematic mechanisms; and a controller, wherein said frame structure comprises vertical guides engaged simultaneously by said first and said second operating beams, wherein said loading machine comprises a gearbox for transmission of motion from said motor to said first and said second operating beams, said gearbox comprising:

a drive shaft having a longitudinal axis, operated by said motor, at least a first connecting rod and crank kinematic mechanism and a second connecting rod and crank kinematic mechanism connected to said first operating beam, and at least a third connecting rod and crank kinematic mechanism and a fourth connecting rod and crank kinematic mechanism connected to said second operating beam, wherein said first and second kinematic mechanisms are connected to said drive shaft respectively by a first cam and a second cam with globoidal profile, said third and fourth kinematic mechanisms are connected to said drive shaft respectively by a third cam and a fourth cam with globoidal profile, so that the alternating vertical translation movement of said first beam is independent from the alternating movement of said second beam.

2. The improved loading machine according to claim 1, wherein said first cam and said second cam are the same as each other, said third cam and said fourth cam are the same as each other, but said first cam and said second cam are different from said third cam and said fourth cam, to obtain movements with different speeds and accelerations of said first operating beam and the second operating beam.

3. The improved loading machine according to claim 1, wherein each of said first, second, third, and fourth kinematic mechanisms comprises a crank, a connecting rod, and a sliding rod connected to one another by hinges, said crank being operated by the rotation of said drive shaft and said sliding rod being integral with the respective operating beam.

4. The improved loading machine according to claim 3, wherein said crank comprises a rocker provided with a plurality of rollers configured to be driven by the respective cam with globoidal profile.

5. The improved loading machine according to claim 4, wherein each rocker comprises a shaft at the ends of which the cranks of the respective kinematic mechanisms are constrained.

6. The improved loading machine according to claim 3, wherein said frame structure comprises sleeve guides configured to house said sliding rods.

7. The improved loading machine according to claim 1, wherein said gearbox further comprises:

at least a fifth connecting rod and crank kinematic mechanism and a sixth connecting rod and crank kinematic mechanism connected to said first operating beam, arranged symmetrically with respect to said first and second kinematic mechanisms with respect to a vertical plane passing through the axis of said drive shaft, and at least a seventh connecting rod and crank kinematic mechanism and an eighth connecting rod and crank kinematic mechanism connected to said second operating beam, arranged symmetrically with respect to said third and fourth kinematic mechanisms with respect to a vertical plane passing through the axis of said drive shaft.

8. The improved loading machine according to claim 7, wherein each rocker comprises a shaft, at the ends of which the cranks of the respective kinematic mechanisms are constrained.

9. The improved loading machine according to claim 1, wherein said baller feeder comprises a rotary table and said gearbox further comprises another kinematic mechanism connected to said drive shaft by a fifth cam with globoidal profile, where said other kinematic mechanism is configured to transform the continuous motion of said drive shaft into an intermittent rotary motion for said rotary table.

10. The improved loading machine according to claim 9, wherein said rotary table comprises grippers configured to grip said ogival balls arranged at the four vertices of a square.

11. The improved loading machine according to claim 9, wherein said other kinematic mechanism comprises a grooved shaft.

12. The improved loading machine according to claim 9, wherein said other kinematic mechanism comprises a rocker provided with a plurality of rollers configured to be driven by said fifth cam with globoidal profile.

* * * * *